US007972475B2

(12) United States Patent
Chan et al.

(10) Patent No.: US 7,972,475 B2
(45) **Date of Patent: *Jul. 5, 2011**

(54) SOFT TISSUE PAPER HAVING A POLYHYDROXY COMPOUND AND LOTION APPLIED ONTO A SURFACE THEREOF

(75) Inventors: Eric Chan, Mason, OH (US); Brooke Marie Woods, Springfield Township, OH (US); LaTisha Evette Salaam, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 146 days.

This patent is subject to a terminal disclaimer.

(21) Appl. No.: 12/350,982

(22) Filed: Jan. 9, 2009

(65) Prior Publication Data

US 2009/0188637 A1 Jul. 30, 2009

Related U.S. Application Data

(63) Continuation-in-part of application No. 12/011,557, filed on Jan. 28, 2008, now Pat. No. 7,867,361.

(51) Int. Cl.
*D21H 27/30* (2006.01)
*D21H 19/72* (2006.01)

(52) U.S. Cl. ..... 162/111; 162/109; 162/135; 162/168.1; 162/179; 162/158; 162/127; 162/172; 162/173; 428/195.1; 428/172; 428/153; 424/402

(58) Field of Classification Search ..... 162/109, 162/123, 135–136, 158, 179, 111, 127, 172, 162/173; 428/195.1, 172, 153; 424/402
See application file for complete search history.

(56) References Cited

U.S. PATENT DOCUMENTS

| | | | | | |
|---|---|---|---|---|---|
| 2,826,551 | A | | 3/1958 | Geen et al. | |
| 3,700,623 | A | | 10/1972 | Keim | |
| 3,772,076 | A | | 11/1973 | Keim | |
| 3,779,791 | A | * | 12/1973 | Ploetz et al. | 422/1 |
| 3,896,807 | A | * | 7/1975 | Buchalter | 604/289 |
| 3,964,500 | A | | 6/1976 | Drakoff | |
| 3,994,771 | A | | 11/1976 | Morgan, Jr. et al. | |
| 4,011,389 | A | | 3/1977 | Langdon | |
| 4,166,001 | A | | 8/1979 | Dunning et al. | |
| 4,300,981 | A | | 11/1981 | Carstens | |
| 4,364,837 | A | | 12/1982 | Pader | |
| 4,486,374 | A | | 12/1984 | Stelzer | |
| 4,529,480 | A | | 7/1985 | Trokhan | |
| 4,874,465 | A | | 10/1989 | Cochrane et al. | |
| 4,981,557 | A | | 1/1991 | Bjorkquist | |
| 5,059,282 | A | | 10/1991 | Ampulski et al. | |
| 5,215,626 | A | | 6/1993 | Ampulski et al. | |
| 5,223,096 | A | | 6/1993 | Phan | |
| 5,228,954 | A | | 7/1993 | Vinson et al. | |
| 5,240,562 | A | | 8/1993 | Phan | |
| 5,246,545 | A | | 9/1993 | Ampulski et al. | |
| 5,334,286 | A | * | 8/1994 | Van Phan et al. | 162/158 |
| 5,385,642 | A | * | 1/1995 | Van Phan et al. | 162/112 |
| 5,397,435 | A | * | 3/1995 | Ostendorf et al. | 162/112 |
| 5,405,499 | A | | 4/1995 | Vinson | |
| 5,405,501 | A | * | 4/1995 | Phan et al. | 162/127 |
| 5,415,737 | A | | 5/1995 | Phan et al. | |
| 5,427,696 | A | * | 6/1995 | Phan et al. | 162/158 |
| 5,437,766 | A | * | 8/1995 | Van Phan et al. | 162/127 |
| 5,474,689 | A | * | 12/1995 | Laughlin et al. | 162/158 |
| 5,510,000 | A | | 4/1996 | Phan et al. | |
| 5,525,345 | A | | 6/1996 | Warner et al. | |
| 5,529,665 | A | | 6/1996 | Kaun | |
| 5,538,595 | A | | 7/1996 | Trokhan et al. | |
| 5,543,067 | A | * | 8/1996 | Phan et al. | 106/287.25 |
| 5,558,873 | A | | 9/1996 | Funk | |
| 5,575,891 | A | * | 11/1996 | Trokhan et al. | 162/111 |
| 5,624,532 | A | * | 4/1997 | Trokhan et al. | 162/111 |
| 5,624,676 | A | | 4/1997 | Mackey et al. | |
| 5,705,164 | A | | 1/1998 | Mackey et al. | |
| 5,716,692 | A | | 2/1998 | Warner et al. | |
| 5,830,487 | A | | 11/1998 | Klofta et al. | |
| 5,840,403 | A | * | 11/1998 | Trokhan et al. | 428/154 |
| 5,935,384 | A | * | 8/1999 | Taniguchi | 162/172 |
| 5,981,044 | A | * | 11/1999 | Phan et al. | 428/212 |
| 6,117,525 | A | * | 9/2000 | Trokhan et al. | 428/154 |
| 6,146,648 | A | * | 11/2000 | Bret et al. | 424/401 |
| 6,162,327 | A | * | 12/2000 | Batra et al. | 162/109 |
| 6,162,329 | A | | 12/2000 | Vinson et al. | |
| 6,261,580 | B1 | | 7/2001 | Lehrter et al. | |
| 6,268,028 | B1 | * | 7/2001 | Buchanan et al. | 428/34.2 |
| 6,428,794 | B1 | | 8/2002 | Klofta et al. | |
| 6,607,637 | B1 | | 8/2003 | Vinson et al. | |
| 6,733,772 | B1 | * | 5/2004 | Bret et al. | 424/443 |
| 6,872,282 | B1 | * | 3/2005 | Kohler et al. | 162/135 |
| 6,905,697 | B2 | | 6/2005 | Kawa et al. | |
| 7,147,751 | B2 | | 12/2006 | Shannon | |
| 7,195,771 | B1 | | 3/2007 | Hsu | |
| D570,608 | S | * | 6/2008 | Salaam et al. | D5/20 |
| 7,407,560 | B2 | | 8/2008 | Hilbig et al. | |
| 7,485,373 | B2 | * | 2/2009 | Krzysik et al. | 428/532 |
| 7,867,361 | B2 | * | 1/2011 | Salaam et al. | 162/123 |
| 2002/0120241 | A1 | * | 8/2002 | Tyrrell et al. | 604/364 |
| 2005/0136265 | A1 | | 6/2005 | Liu | |
| 2006/0278357 | A1 | * | 12/2006 | Suzuki et al. | 162/117 |
| 2007/0071797 | A1 | | 3/2007 | Hernandez-Munoa et al. | |
| 2008/0087395 | A1 | * | 4/2008 | Prodoehl et al. | 162/125 |
| 2008/0314535 | A1 | * | 12/2008 | Hilbig et al. | 162/109 |
| 2009/0104430 | A1 | * | 4/2009 | Cordial et al. | 428/322.7 |
| 2009/0188636 | A1 | * | 7/2009 | Salaam et al. | 162/112 |
| 2009/0188637 | A1 | * | 7/2009 | Chan et al. | 162/112 |
| 2010/0136294 | A1 | * | 6/2010 | Manifold et al. | 428/171 |
| 2011/0027596 | A1 | * | 2/2011 | Leimbach et al. | 428/447 |

FOREIGN PATENT DOCUMENTS

| | | | |
|---|---|---|---|
| EP | 0 613 979 | A1 | 9/1994 |
| EP | 0 688 901 | A2 | 12/1995 |
| EP | 0 803012 | B1 | 6/1999 |
| GB | 849433 | | 9/1960 |
| WO | WO 98/29605 | A | 8/1998 |
| WO | WO 99/16974 | A | 4/1999 |
| WO | WO 2005/103356 | A2 | 11/2005 |
| WO | WO 2006/038936 | A1 | 4/2006 |
| WO | WO 2007025095 | A1 * | 3/2007 |
| WO | WO 2009097231 | A1 * | 8/2009 |

* cited by examiner

OTHER PUBLICATIONS

Lammle, S., "Use of Glycerine as a Softener for Paper Product", *The World's Paper Trade Review*, pp. 2051-2056, Dec. 13, 1962.

*Primary Examiner* — José A Fortuna
(74) *Attorney, Agent, or Firm* — Peter D. Meyer

(57) ABSTRACT

The present invention provides a paper product having at least one ply, wherein only one outer surface of said tissue paper has a polyhydroxy compound and a lotion applied thereto.

18 Claims, No Drawings

SOFT TISSUE PAPER HAVING A POLYHYDROXY COMPOUND AND LOTION APPLIED ONTO A SURFACE THEREOF

PRIORITY DATA

This application is a continuation-in-part of U.S. patent application Ser. No. 12/011,557 filed on Jan. 28, 2008, now U.S. Pat. No. 7,867,361.

FIELD OF THE INVENTION

This invention relates, in general, to tissue paper products. More specifically, it relates to tissue paper products having polyhydroxy compounds applied thereto.

BACKGROUND OF THE INVENTION

Sanitary paper tissue products are widely used. Such items are commercially offered in formats tailored for a variety of uses such as facial tissues, toilet tissues and absorbent towels.

All of these sanitary products share a common need, specifically to be soft to the touch. Softness is a complex tactile impression elicited by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining the before mentioned discharges for disposal in a sanitary fashion. Not surprisingly, the use of these products does not approach the level of cleanliness that can be achieved by the more thorough cleansing methods, and producers of tissue and toweling products are constantly striving to make their products compete more favorably with thorough cleansing methods.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been exploited in this regard has been to select and modify cellulose fiber morphologies and engineer paper structures to take optimum advantages of the various available morphologies. Applicable art in this area include in U.S. Pat. Nos. 5,228,954; 5,405,499; 4,874,465; and 4,300,981. Another area which has received a considerable amount of attention is the addition of chemical softening agents (also referred to herein as "chemical softeners") to tissue and toweling products.

As used herein, the term "chemical softening agent" refers to any chemical ingredient which improves the tactile sensation perceived by the consumer that holds a particular paper product and rubs it across the skin. Although somewhat desirable for towel products, softness is a particularly important property for facial and toilet tissues. Such tactile perceivable softness can be characterized by, but is not limited to, friction, flexibility, and smoothness, as well as subjective descriptors, such as lubricious, velvet, silk or flannel, which imparts a lubricious feel to tissue. This includes, for exemplary purposes only, polyhydroxy compounds.

Thus, it would be advantageous to provide for the addition of chemical softeners to already-dried paper webs either at the so-called dry end of the papermaking machine or in a separate converting operation subsequent to the papermaking step. Exemplary art from this field includes U.S. Pat. Nos. 5,215,626; 5,246,545; and 5,525,345. While each of these references represents advances over the previous so-called wet end methods particularly with regard to eliminating the degrading effects on the papermaking process, none are able to completely address the necessary degree of softness required by consumers.

One of the most important physical properties related to softness is generally considered by those skilled in the art to be the strength of the web. Strength is the ability of the product, and its constituent webs, to maintain physical integrity and to resist tearing, bursting, and shredding under use conditions. Achieving a high softening potential without degrading strength has long been an object of workers in the field of the present invention.

Accordingly, it would be desirable to be able to soften tissue paper, in particular high bulk, pattern densified tissue papers, by a process that: (1) can be carried out in a commercial papermaking system without significantly impacting on machine operability; (2) uses softeners that are nontoxic and biodegradable; and (3) can be carried out in a manner so as to maintain desirable tensile strength, absorbency and low lint properties of the tissue paper.

SUMMARY OF THE INVENTION

One embodiment of the present invention provides for a paper product having at least one ply, wherein only one outer surface of said tissue paper has a polyhydroxy compound and a lotion applied thereto.

Another embodiment of the present invention provides for a paper product having at least one ply, wherein only one outer surface of said paper product comprises from about 0.1 $g/m^2$ to about 36 $g/m^2$ of a polyhydroxy compound from about 0.1 $g/m^2$ to about 30 $g/m^2$ of a lotion applied thereto.

Yet another embodiment of the present invention provides for a paper product having at least one ply, wherein only one outer surface of said tissue paper comprises from about 2.0 percent to about 25.0 percent of a lotion based upon a dry fiber weight of said paper product and from about 2.0 percent to about 30.0 percent of a water soluble polyhydroxy compound based upon a dry fiber weight of said paper product.

DETAILED DESCRIPTION OF THE INVENTION

As used herein, the term "water soluble" refers to materials that are soluble in water to at least 3%, by weight, at 25° C.

As used herein, the terms "tissue paper web", "paper web", "web", "paper sheet", "tissue paper", "tissue product", and "paper product" are all used interchangeably to refer to sheets of paper made by a process comprising the steps of forming an aqueous papermaking furnish, depositing this furnish on a foraminous surface, such as a Fourdrinier wire, and removing the water from the furnish (e.g., by gravity or vacuum-assisted drainage), forming an embryonic web, transferring the embryonic web from the forming surface to a transfer surface traveling at a lower speed than the forming surface. The web is then transferred to a fabric upon which it is through air dried to a final dryness after which it is wound upon a reel.

The terms "multi-layered tissue paper web", "multi-layered paper web", "multi-layered web", "multi-layered paper sheet," and "multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

As used herein, the term "single-ply tissue product" means that it is comprised of one ply of creped or un-creped tissue; the ply can be substantially homogeneous in nature or it can be a multi-layered tissue paper web. As used herein, the term "multi-ply tissue product" means that it is comprised of more than one ply of creped or uncreped tissue. The plies of a multi-ply tissue product can be substantially homogeneous in nature or they can be multi-layered tissue paper webs.

As used herein, the term "polyhydroxy compounds" is defined as a chemical agent that imparts lubricity or emolliency to tissue paper products and also possesses permanence with regard to maintaining the fidelity of its deposits without substantial migration when exposed to the environmental conditions to which products of this type are ordinarily exposed during their typical life cycle. The present invention contains as an essential component from about 2.0% to about 30.0%, preferably from 5% to about 20.0%, more preferably from about 8.0% to about 15.0%, of a water soluble polyhydroxy compound based on the dry fiber weight of the tissue paper. In another embodiment, the present invention may contain as an essential component an application of from about 0.1 $g/m^2$ to about 36 $g/m^2$, preferably from about 0.55 $g/m^2$ to about 20 $g/m^2$ more preferably from about 0.65 $g/m^2$ to about 12 $g/m^2$, of a water soluble polyhydroxy compound to the tissue paper.

Examples of water soluble polyhydroxy compounds suitable for use in the present invention include glycerol, polyglycerols having a weight average molecular weight of from about 150 to about 800 and polyoxyethylene and polyoxypropylene having a weight-average molecular weight of from about 200 to about 4000, preferably from about 200 to about 1000, most preferably from about 200 to about 600. Polyoxyethylene having a weight average molecular weight of from about 200 to about 600 are especially preferred. Mixtures of the above-described polyhydroxy compounds may also be used. For example, mixtures of glycerol and polyglycerols, mixtures of glycerol and polyoxyethylenes, 'mixtures of polyglycerols and polyoxyethylenes, etc. are useful in the present invention. A particularly preferred polyhydroxy compound is polyoxyethylene having a weight average molecular weight of about 200. This material is available commercially from the BASF Corporation of Florham Park, N.J. under the trade names "Pluriol E200" and "Pluracol E200".

As used herein, the term "lotion" is defined as an oil, emollient, wax, and/or immobilizing agent intended for external application to a surface that can be adapted to contain agents for soothing or softening the skin, such as that of the face or hands. In one example, the lotion composition comprises from about 10% to about 90% and/or from about 30% to about 90% and/or from about 40% to about 90% and/or from about 40% to about 85% of an oil, wax, and/or emollient. In another example, the lotion composition comprises from about 10% to about 50% and/or from about 15% to about 45% and/or from about 20% to about 40% of an immobilizing agent. In another example, the lotion composition comprises from about 0% to about 60% and/or from about 5% to about 50% and/or from about 5% to about 40% of petrolatum.

Lotion compositions of the present invention may be heterogeneous. They may contain solids, gel structures, polymeric material, a multiplicity of phases (such as oily and water phase) and/or emulsified components. It may be difficult to determine precisely the melting temperature of the lotion composition (i.e. difficult to determine the temperature of transition between the liquid form, the quasi-liquid form, the quasi-solid form, and the solid form). The terms melting temperature, melting point, transition point and transition temperature are used interchangeably in this document and have the same meaning. The lotion can be applied to a substrate in combination with other additives including, but not limited to, polyhydroxy compounds. As one of skill in the art would recognize, a lotion of the present invention may be combined with a polyhydroxy compound of the present invention and applied to the surface of a tissue paper web of the present invention as a mixture, or may be applied to a tissue paper web neat followed by an application of a polyhydroxy compound. Alternatively, as would be known to one of skill in the art, a polyhydroxy compound may be applied to the surface of a tissue paper web neat followed by an application of a lotion.

The lotion compositions may be semi-solid, of high viscosity so they do not substantially flow without activation during the life of the product or gel structures. The lotion compositions may be shear thinning and/or they may strongly change their viscosity around skin temperature to allow for transfer and easy spreading on a user's skin. Additionally, the lotion compositions may be in the form of emulsions and/or dispersions.

In one example of a lotion composition, the lotion composition has a water content of less than about 20% and/or less than 10% and/or less than about 5% or less than about 0.5%. In another example, the lotion composition may have a solids content of at least about 15% and/or at least about 25% and/or at least about 30% and/or at least about 40% to about 100% and/or to about 95% and/or to about 90% and/or to about 80%.

A non-limiting example of a suitable lotion composition of the present invention comprises a chemical softening agent, such as oil and/or emollient, that softens, soothes, supplies, coats, lubricates, or moisturizes the skin. The lotion composition may sooth, moisturize, and/or lubricate a user's skin. Non-limiting examples of suitable oils and/or emollients include glycols (such as propylene glycol and/or glycerine), polyglycols (such as triethylene glycol), petrolatum, fatty acids, fatty alcohols, fatty alcohol ethoxylates, fatty alcohol esters and fatty alcohol ethers, fatty acid ethoxylates, fatty acid amides and fatty acid esters, hydrocarbon oils (such as mineral oil), squalane, fluorinated emollients, silicone oil (such as dimethicone) and mixtures thereof. Non-limiting examples of emollients useful in the present invention can be petroleum-based, fatty acid ester type, alkyl ethoxylate type, or mixtures of these materials. Suitable petroleum-based emollients include those hydrocarbons, or mixtures of hydrocarbons, having chain lengths of from 16 to 32 carbon atoms. Petroleum based hydrocarbons having these chain lengths include petrolatum (also known as "mineral wax," "petroleum jelly" and "mineral jelly"). Petrolatum usually refers to more viscous mixtures of hydrocarbons having from 16 to 32 carbon atoms. A suitable Petrolatum is available from Witco, Corp., Greenwich, Conn. as White Protopet®1 S.

Suitable fatty acid ester emollients include those derived from long chain $C_{12}$-$C_{28}$ fatty acids, such as $C_{16}$-$C_{22}$ saturated fatty acids, and short chain $C_1$-$C_8$ monohydric alcohols, such as $C_1$-$C_3$ monohydric alcohols. Non-limiting examples of suitable fatty acid ester emollients include methyl palmitate, methyl stearate, isopropyl laurate, isopropyl myristate, isopropyl palmitate, and ethylhexyl palmitate. Suitable fatty acid ester emollients can also be derived from esters of longer chain fatty alcohols ($C_{12}$-$C_{28}$, such as $C_{12}$-$C_{16}$) and shorter chain fatty acids e.g., lactic acid, such as lauryl lactate and cetyl lactate.

Suitable alkyl ethoxylate type emollients include $C_{12}$-$C_{18}$ fatty alcohol ethoxylates having an average of from 3 to 30 oxyethylene units, such as from about 4 to about 23 oxyethylene units. Non-limiting examples of such alkyl ethoxylates include laureth-3 (a lauryl ethoxylate having an average of 3 oxyethylene units), laureth-23 (a lauryl ethoxylate having an average of 23 oxyethylene units), ceteth-10 (acetyl ethoxylate having an average of 10 oxyethylene units), steareth-2 (a stearyl ethoxylate having an average of 2 oxyethylene units) and steareth-10 (a stearyl ethoxylate having an average of 10 oxyethylene units). These alkyl ethoxylate emollients are typically used in combination with the petroleum-based emollients, such as petrolatum, at a weight ratio of alkyl ethoxylate emollient to petroleum-based emollient of from about 1:1 to about 1:3, preferably from about 1:1.5 to about 1:2.5.

The lotion compositions of the present invention may include an "immobilizing agent." Without desiring to be bound by theory, it is believed that immobilizing agents are believed to prevent migration of the emollient so that it can remain primarily on the surface of the fibrous structure to which it is applied. In this way, the emollient may deliver maximum softening benefit as well as be available for transferability to the user's skin. Suitable immobilizing agents for the present invention can comprise polyhydroxy fatty acid esters, polyhydroxy fatty acid amides, and mixtures thereof. To be useful as immobilizing agents, the polyhydroxy moiety of the ester or amide should have at least two free hydroxy groups. It is believed that these free hydroxy groups are the ones that co-crosslink through hydrogen bonds with the cellulosic fibers of the tissue paper web to which the lotion composition is applied and homo-crosslink, also through hydrogen bonds, the hydroxy groups of the ester or amide, thus entrapping and immobilizing the other components in the lotion matrix. Non-limiting examples of suitable esters and amides will have three or more free hydroxy groups on the polyhydroxy moiety and are typically nonionic in character. Because of the skin sensitivity of those using paper products to which the lotion composition is applied, these esters and amides should also be relatively mild and non-irritating to the skin.

Suitable polyhydroxy fatty acid esters for use in the present invention will have the formula:

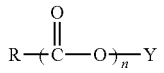

wherein R is a $C_5$-$C_3$, hydrocarbyl group, such as a straight chain $C_7$-$C_{19}$ alkyl or alkenyl and/or a straight chain $C_9$-$C_{17}$ alkyl or alkenyl and/or a straight chain $C_{11}$-$C_{17}$ alkyl or alkenyl, or mixture thereof; Y is a polyhydroxyhydrocarbyl moiety having a hydrocarbyl chain with at least 2 free hydroxyls directly connected to the chain; and n is at least 1. Suitable Y groups can be derived from polyols such as glycerol, pentaerythritol; sugars such as raffinose, maltodextrose, galactose, sucrose, glucose, xylose, fructose, maltose, lactose, mannose and erythrose; sugar alcohols such as erythritol, xylitol, malitol, mannitol and sorbitol; and anhydrides of sugar alcohols such as sorbitan. One class of suitable polyhydroxy fatty acid esters for use in the present invention comprises certain sorbitan esters, such as sorbitan esters of $C_{16}$-$C_{22}$ saturated fatty acids.

Immobilizing agents include agents that are may prevent migration of the emollient into the fibrous structure such that the emollient remain primarily on the surface of the fibrous structure and/or sanitary tissue product and/or on the surface treating composition on a surface of the fibrous structure and/or sanitary tissue product and facilitate transfer of the lotion composition to a user's skin. Immobilizing agents may function as viscosity increasing agents and/or gelling agents.

Non-limiting examples of suitable immobilizing agents include waxes (such as ceresin wax, ozokerite, microcrystalline wax, petroleum waxes, fisher tropsh waxes, silicone waxes, paraffin waxes), fatty alcohols (such as cetyl, cetaryl, cetearyl and/or stearyl alcohol), fatty acids and their salts (such as metal salts of stearic acid), mono and polyhydroxy fatty acid esters, mono and polyhydroxy fatty acid amides, silica and silica derivatives, gelling agents, thickeners and mixtures thereof. In one example, the lotion composition comprises at least one immobilizing agent and at least one emollient.

One or more skin benefit agents may be included in the lotion composition of the present invention. If a skin benefit agent is included in the lotion composition, it may be present in the lotion composition at a level of from about 0.5% to about 80% and/or 0.5% to about 70% and/or from about 5% to about 60% by weight of the lotion. Non-limiting examples of skin benefit agents include zinc oxide, vitamins, such as Vitamin B3 and/or Vitamin E, sucrose esters of fatty acids, such as Sefose 1618S (commercially available from Procter & Gamble Chemicals), antiviral agents, anti-inflammatory compounds, lipid, inorganic anions, inorganic cations, protease inhibitors, sequestration agents, chamomile extracts, aloe vera, calendula officinalis, alpha bisalbolol, Vitamin E acetate and mixtures thereof.

Non-limiting examples of suitable skin benefit agents include fats, fatty acids, fatty acid esters, fatty alcohols, triglycerides, phospholipids, mineral oils, essential oils, sterols, sterol esters, emollients, waxes, humectants and combinations thereof.

In one example, the skin benefit agent may be any substance that has a higher affinity for oil over water and/or provides a skin health benefit by directly interacting with the skin. Suitable examples of such benefits include, but are not limited to, enhancing skin barrier function, enhancing moisturization and nourishing the skin.

The skin benefit agent may be alone, included in a lotion composition and/or included in a surface treating composition. A commercially available lotion composition comprising a skin benefit agent is Vaseline® Intensive Care Lotion (Chesebrough-Pond's, Inc.).

The lotion composition may be a transferable lotion composition. A transferable lotion composition comprises at least one component that is capable of being transferred to an opposing surface such as a user's skin upon use. In one example, at least 0.1% of the transferable lotion present on the user contacting surface transfers to the user's skin during use.

Other optional ingredients that may be included in the lotion composition include vehicles, perfumes, especially long lasting and/or enduring perfumes, antibacterial actives, antiviral actives, disinfectants, pharmaceutical actives, film formers, deodorants, opacifiers, astringents, solvents, cooling sensate agents, such as camphor, thymol and menthol.

EXAMPLE 1 OF LOTION COMPOSITION

| | |
|---|---|
| Stearyl Alcohol CO1897* | 40% w/w |
| Petrolatum Snowwhite V28EP** | 30% w/w |
| Mineral oil Carnation** | 30% w/w |

*Available from Procter & Gamble Chemicals, Cincinnati, USA
**Available from Witco The lotion composition has a melting point of about 51° C. and a melt viscosity at 56° C. of about 17 m*Pas measured at a shear rate of 0.1 l/s. The mineral oil used in this formulation has a viscosity of about 21 mpa*s at 20° C.

EXAMPLE 2 OF LOTION COMPOSITION

| | |
|---|---|
| Mineral oil* | 55% w/w |
| Paraffin** | 12% w/w |
| Cetaryl alcohol | 21% w/w |
| Steareth-2*** | 11% w/w |
| Skin benefit agent | 1% w/w |

*Drakeol 7PG available from Penreco
**Chevron 128 available from Chevron
***Available from Abitec Corporation The present invention contains as an essential component from about 2.0% to about 25.0% and preferably from 4.0% to about 11.0% of lotion based on the dry fiber weight of the tissue paper. In another embodiment, the present invention may contain as an essential component an application of from about 0.1 g/m$^2$ to about 30 g/m$^2$, preferably from about 0.55 g/m$^2$ to about 16.3 g/m$^2$, and more preferably from about 0.65 g/m$^2$ to about 10 g/m$^2$ of a lotion to the tissue paper.

The soft tissue paper of the present invention preferably has a basis weight ranging from between about 5 g/m$^2$ and about 120 g/m$^2$, more preferably between about 10 g/m$^2$ and about 75 g/m$^2$, and even more preferably between about 10 g/m$^2$ and about 50 g/m$^2$. The soft tissue paper of the present invention preferably has a density ranging from between about 0.01 g/cm$^3$ and about 0.19 g/cm$^3$, more preferably between about 0.02 g/m$^3$ and about 0.1 g/cm$^3$, and even more preferably between about 0.03 g/cm$^3$ and about 0.08 g/cm$^3$.

The soft tissue paper of the present invention further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The tissue paper product of the present invention is preferably creped, i.e., produced on a papermaking machine culminating with a Yankee dryer to which a partially dried papermaking web is adhered and upon which it is dried and from which it is removed by the action of a flexible creping blade.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large diameter, generally 8-20 foot drum which is designed to be pressurized with steam to provide a hot surface for completing the drying of papermaking webs at the end of the papermaking process. The paper web which is first formed on a foraminous forming carrier, such as a Fourdrinier wire, where it is freed of the copious water needed to disperse the fibrous slurry is generally transferred to a felt or fabric in a so-called press section where de-watering is continued either by mechanically compacting the paper or by some other de-watering method such as through-drying with hot air, before finally being transferred in the semi-dry condition to the surface of the Yankee for the drying to be completed.

While the characteristics of the creped paper webs, particularly when the creping process is preceded by methods of pattern densification, are preferred for practicing the present invention, un-creped tissue paper is also a satisfactory substitute and the practice of the present invention using un-creped tissue paper is specifically incorporated within the scope of the present invention. Un-creped tissue paper, a term as used herein, refers to tissue paper which is non-compressively dried, most preferably by through-drying. Resultant through air dried webs are pattern densified such that zones of relatively high density are dispersed within a high bulk field, including pattern densified tissue wherein zones of relatively high density are continuous and the high bulk field is discrete.

To produce un-creped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

Tissue paper webs are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in tissue papers are virgin chemical wood pulps. Additionally, filler materials may also be incorporated into the tissue papers of the present invention.

Preferably, softening agents such as quaternary ammonium compounds can be added to the papermaking slurry. Preferred exemplary quaternary compounds have the formula:

$$(R_1)_{4-m}—N^+—[R_2]_mX^-$$

wherein:

m is 1 to 3;

$R_1$ is a $C_1$-$C_6$ alkyl group, hydroxyalkyl group, hydrocarbyl or substituted hydrocarbyl group, alkoxylated group, benzyl group, or mixtures thereof;

$R_2$ is a $C_{14}$-$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention.

Preferably, each $R_1$ is methyl and $X^-$ is chloride or methyl sulfate. Preferably, each $R_2$ is $C_{16}$-$C_{18}$ alkyl or alkenyl, most preferably each $R_2$ is straight-chain $C_{18}$ alkyl or alkenyl. Optionally, the $R_2$ substituent can be derived from vegetable oil sources.

Such structures include the well-known dialkyldimethylammonium salts (e.g. ditallowdimethylammonium chloride, ditallowdimethylammonium methyl sulfate, di(hydrogenated tallow)dimethyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964) tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements the saturation level of the ditallow can be tailored from non-hydrogenated (soft) to touch, partially or completely hydrogenated (hard). All of above-described levels of saturations are expressly meant to be included within the scope of the present invention.

Particularly preferred variants of these softening agents are what are considered to be mono- or di-ester variations of these quaternary ammonium compounds having the formula:

$$(R_1)_{4-m}—N^+—[(CH_2)_n—Y—R_3]_mX^-$$

wherein:

Y is —O—(O)C—, or —C(O)—O—, or —NH—C(O)—, or —C(O)—NH—;

m is 1 to 3;

n is 0 to 4;

each $R_1$ is a $C_1$-$C_6$ alkyl group, hydroxyalkyl group, hydrocarbyl or substituted hydrocarbyl group, alkoxylated group, benzyl group, or mixtures thereof;

each $R_3$ is a $C_{13}$-$C_{21}$ alkyl group, hydroxyalkyl group, hydrocarbyl or substituted hydrocarbyl group, alkoxylated group, benzyl group, or mixtures thereof; and $X^-$ is any softener-compatible anion.

Preferably, Y=—O—(O)C—, or —C(O)—O—; m=2; and n=2. Each $R_1$ substituent is preferably a $C_1$-$C_3$, alkyl group, with methyl being most preferred. Preferably, each $R_3$ is $C_{13}$-$C_{17}$ alkyl and/or alkenyl, more preferably $R_3$ is straight chain $C_{15}$-$C_{17}$ alkyl and/or alkenyl, $C_{15}$-$C_{17}$ alkyl, most preferably each $R_3$ is straight-chain $C_{17}$ alkyl. Optionally, the $R_3$ substituent can be derived from vegetable oil sources.

As mentioned above, $X^-$ can be any softener-compatible anion, for example, acetate, chloride, bromide, methylsulfate, formate, sulfate, nitrate and the like. Preferably $X^-$ is chloride or methyl sulfate.

Specific examples of ester-functional quaternary ammonium compounds having the structures detailed above and suitable for use in the present invention may include the diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated)tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

Typically, half of the fatty acids present in tallow are unsaturated, primarily in the form of oleic acid. Synthetic as well as natural "tallows" fall within the scope of the present invention. It is also known that depending upon the product characteristic requirements desired in the final product, the saturation level of the ditallow can be tailored from non hydrogenated (soft) to touch, partially or completely hydrogenated (hard). All of above-described levels of saturations are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$-$C_{18}$ alkyl and/or alkenyl, most preferably each $R_2$ is straight-chain $C_{16}$-$C_{18}$ alkyl and/or alkenyl, most preferably each $R_2$ is straight-chain $C_{18}$ alkyl or alkenyl. Preferably $R_3$ is C13-C17 alkyl and/or alkenyl, most preferably $R_3$ is straight chain $C_{15}$-$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g., $(R_2)_2—N^+—((CH_2)_2\ OH)((CH_2)_2\ OC(O)R_3)\ X^-$ as minor ingredients. These minor ingredients can act as emulsifiers and can be useful in the present invention.

Other types of suitable quaternary ammonium compounds for use in the present invention are described in U.S. Pat. Nos. 5,543,067; 5,538,595; 5,510,000; 5,415,737, and European Patent Application No. 0 688 901 A2.

Di-quaternary variations of the ester-functional quaternary ammonium compounds can also be used, and are meant to fall within the scope of the present invention. These compounds have the formula:

$$R_1—C(=O)—O—(CH_2)_2—N^+(R_1)_2—(CH_2)_nN^+(R_1)_2—(CH_2)_2—O—C(=O)—R_3\quad 2X^-$$

In the structure named above each $R_1$ is a $C_1$-$C_6$ alkyl or hydroxyalkyl group, $R_3$ is $C_{11}$-$C_{21}$ hydrocarbyl group, n is 2 to 4 and $X^-$ is a suitable anion, such as a halide (e.g., chloride or bromide) or methyl sulfate. Preferably, each $R_3$ is $C_{13}$-$C_{17}$ alkyl and/or alkenyl, most preferably each $R_3$ is straight-chain $C_{15}$-$C_{17}$ alkyl and/or alkenyl, and $R_1$ is a methyl.

While not wishing to be bound by theory, it is believed that the ester moiety(ies) of the quaternary compounds provides a measure of biodegradability. It is believed the ester-functional quaternary ammonium compounds used herein biodegrade more rapidly than do conventional dialkyl dimethyl ammonium chemical softeners.

The use of quaternary ammonium ingredients before is most effectively accomplished if the quaternary ammonium ingredient is accompanied by an appropriate plasticizer. The plasticizer can be added during the quaternizing step in the manufacture of the quaternary ammonium ingredient or it can be added subsequent to the quaternization but prior to the application in the papermaking slurry as a chemical softening agent. The plasticizer is characterized by being substantially inert during the chemical synthesis, but acts as a viscosity reducer to aid in the synthesis and subsequent handling, i.e. application of the quaternary ammonium compound to the tissue paper product. Preferred plasticizers are comprised of a combination of a non-volatile polyhydroxy compound and a fatty acid. Preferred polyhydroxy compounds include glycerol and polyethylene glycols having a molecular weight of from about 200 to about 2000, with polyethylene glycol having a molecular weight of from about 200 to about 600 being particularly preferred. Preferred fatty acids comprise $C_6$-$C_{23}$ linear or branched and saturated or unsaturated analogs with isostearic acid being the most preferred.

While not wishing to be bound by theory, it is believed that a synergism results from the relationship of the polyhydroxy compound and the fatty acid in the mixture. While the polyhydroxy compound performs the essential function of viscosity reduction, it can be quite mobile after being laid down thus detracting from one of the objects of the present invention, i.e. that the deposited softener be. The inventors have now found that the addition of a small amount of the fatty acid is able to stem the mobility of the polyhydroxy compound and further reduce the viscosity of the mixture so as to increase the processability of compositions of a given quaternary ammonium compound fraction.

Alternative embodiments of preferred chemical softening agents suitable for addition to the papermaking slurry comprise well-known organo-reactive polydimethyl siloxane ingredients, including the most preferred—amino functional polydimethyl siloxane. In this regard, a most preferred form of the chemical softening agent is to combine the organo-reactive silicone with a suitable quaternary ammonium compound. In this embodiment the organo-reactive silicone is preferred to be an amino polydimethyl siloxane and is used at an amount ranging from 0 up to about 50% of the composition by weight, with a preferred usage being in the range of about 5% to about 15% by weight based on the weight of the polysiloxane relative to the total softening agent. Fatty acids useful in this embodiment of the present invention comprises $C_6$-$C_{23}$ linear, branched, saturated, or unsaturated analogs. The most preferred form of such a fatty acid is isostearic acid. One particularly preferred chemical softening agent contains from about 0.1% to about 70% of a polysiloxane compound.

Polysiloxanes which are applicable to chemical softening compositions include polymeric, oligomeric, copolymeric, and other multiple monomeric siloxane materials. As used herein, the term polysiloxane shall include all of such polymeric, oligomeric, copolymeric, and other multiple-monomeric materials. Additionally, the polysiloxane can be straight chained, branched chain, or have a cyclic structure.

Preferred polysiloxane materials include those having monomeric siloxane units of the following structure:

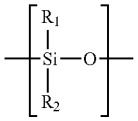

wherein, $R_1$ and $R_1$ for each siloxane monomeric unit can independently be any alkyl, aryl, alkenyl, alkaryl, aralkyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the radicals can be either a straight chain, a branched chain, or have a cyclic structure. The radicals $R_1$ and $R_2$ can, additionally and independently be other silicone functionalities such as, but not limited to siloxanes, polysiloxanes, and polysilanes. The radicals $R_1$ and $R_2$ can also contain any of a variety of organic functionalities including, for example, alcohol, carboxylic acid, and amine functionalities. Reactive, organo-functional silicones, especially amino-functional silicones are preferred for the present invention.

Preferred polysiloxanes include straight chain organopolysiloxane materials of the following general formula:

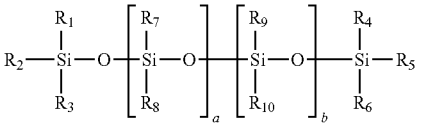

wherein each $R_1$-$R_9$ radical can independently be any $C_1$-$C_{10}$ unsubstituted alkyl or aryl radical, and $R_{10}$ of any substituted $C_1$-$C_{10}$ alkyl or aryl radical. Preferably each $R_1$-$R_9$ radical is independently any $C_1$-$C_4$ unsubstituted alkyl group those skilled in the art will recognize that technically there is no difference whether, for example, $R_9$ or $R_{10}$ is the substituted radical. Preferably the mole ratio of b to (a+b) is between 0 and about 20%, more preferably between 0 and about 10%, and most preferably between about 1% and about 5%.

In one particularly preferred embodiment, $R_1$-$R_9$ are methyl groups and $R_{10}$ is a substituted or unsubstituted alkyl, aryl, or alkenyl group. Such material shall be generally described herein as polydimethylsiloxane which has a particular functionality as may be appropriate in that particular case. Exemplary polydimethylsiloxane include, for example, polydimethylsiloxane having an alkyl hydrocarbon $R_{10}$ radical and polydimethylsiloxane having one or more amino, carboxyl, hydroxyl, ether, polyether, aldehyde, ketone, amide, ester, thiol, and/or other functionalities including alkyl and alkenyl analogs of such functionalities. For example, an amino functional alkyl group as $R_{10}$ could be an amino functional or an aminoalkyl-functional polydimethylsiloxane. The exemplary listing of these polydimethylsiloxanes is not meant to thereby exclude others not specifically listed.

Viscosity of polysiloxanes useful for this invention may vary as widely as the viscosity of polysiloxanes in general vary, so long as the polysiloxane can be rendered into a form which can be applied to the tissue paper product herein. This includes, but is not limited to, viscosity as low as about 25 centistokes to about 20,000,000 centistokes or even higher. High viscosity polysiloxanes which themselves are resistant to flowing can be effectively deposited by emulsifying with a surfactant or dissolution into a vehicle, such as hexane, listed for exemplary purposes only.

While not wishing to be bound by theory, it is believed that the tactile benefit efficacy is related to average molecular weight and that viscosity is also related to average molecular weight. Accordingly, due to the difficulty of measuring molecular weight directly, viscosity is used herein as the apparent operative parameter with respect to imparting softness to tissue paper. References disclosing polysiloxanes include U.S. Pat. Nos. 2,826,551; 3,964,500; 4,364,837; 5,059,282; 5,529,665; 5,552,020; and British Patent 849,433.

It is anticipated that wood pulp in all its varieties will normally comprise the tissue papers with utility in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, ThermoMechanical Pulp (TMP) and Chemi-ThermoMechanical Pulp (CTMP). Pulps derived from both deciduous and coniferous trees can be used.

Hardwood pulps and softwood pulps, as well as combinations of the two, may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises the use of layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

In one preferred embodiment of the present invention, which utilizes multiple papermaking furnishes, the furnish containing the papermaking fibers which will be contacted by the particulate filler is predominantly of the hardwood type, preferably of content of at least about 80% hardwood.

Optional Chemical Additives

Other materials can be added to the aqueous papermaking furnish or the embryonic web to impart other characteristics to the product or improve the papermaking process so long as they are compatible with the chemistry of the softening agent and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One example material is Cypro 514.RTM., a product of Cytec, Inc. of Stamford, Conn. The use of such materials is expressly allowed within the practice of the present invention.

The use of high surface area and high anionic charge microparticles for the purposes of improving formation, drainage, strength, and retention is taught in the art. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene latices; insolubilized polyvinyl alcohol; urea-formaldehyde; polyethyleneimine; chitosan polymers and mixtures thereof can be added to the papermaking furnish or to the embryonic web. Polyamide-epichlorohydrin resins are cationic wet strength resins which have been found to be of particular utility. Suitable types of such resins are described in U.S. Pat. Nos. 3,700,623 and 3,772,076. One commercial source of useful polyamide-epichlorohydrin resins is Hercules, Inc. of Wilmington, Del., which markets such resin under the mark Kymene 557H.RTM.).

Many paper products must have limited strength when wet because of the need to dispose of them through toilets into septic or sewer systems. If wet strength is imparted to these products, it is preferred to be fugitive wet strength characterized by a decay of part or all of its potency upon standing in presence of water. If fugitive wet strength is desired, the binder materials can be chosen from the group consisting of dialdehyde starch or other resins with aldehyde functionality such as Co-Bond 1000.RTM offered by National Starch and Chemical Company, Parez 750.RTM offered by Cytec of Stamford, Conn. and the resin described in U.S. Pat. No. 4,981,557.

If enhanced absorbency is needed, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40.RTM which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520.RTM available from Rhone Poulenc Corporation (Cranbury, N.J.).

The present invention is further applicable to the production of multi-layered tissue paper webs. Multi-layered tissue structures and methods of forming multi-layered tissue structures are described in U.S. Pat. Nos. 3,994,771; 4,300,981; 4,166,001; and European Patent Publication No. 0 613 979 A1. The layers preferably comprise different fiber types, the fibers typically being relatively long softwood and relatively short hardwood fibers as used in multi-layered tissue paper making. Multi-layered tissue paper webs resultant from the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fiber having an average fiber length of least about 2.0 mm. These long paper making fibers are typically softwood fibers, preferably, northern softwood Kraft fibers. Preferably, the majority of the particulate filler of the present invention is contained in at least one of the outer layers of the multi-layered tissue paper web of the present invention. More preferably, the majority of the particulate filler of the present invention is contained in both of the outer layers.

The tissue paper products made from single-layered or multi-layered un-creped tissue paper webs can be single-ply tissue products or multi-ply tissue products.

The multi-layered tissue paper webs of to the present invention can be used in any application where soft, absorbent multi-layered tissue paper webs are required. Particularly advantageous uses of the multi-layered tissue paper web of this invention are in toilet tissue and facial tissue products.

Both single-ply and multi-ply tissue paper products can be produced from the webs of the present invention.

Application of a Polyhydroxy Compounds to Paper Webs

In accordance with the present invention, the polyhydroxy compounds may be applied to a paper web by any application method known in the industry such as, for example, spraying, printing, extrusion, brushing, by means of permeable or impermeable rolls and/or pads. In a first embodiment, the claimed polyhydroxy compound may be applied to a paper web with a slot die. Specifically, the polyhydroxy compound may be extruded onto the surface of a paper web via a heated slot die. The slot die may be any suitable slot die or other means for applying a polyhydroxy compound to the paper web. The slot die or other glue application means may be supplied by any suitable apparatus. For example, the slot die may be supplied by a heated hopper or drum and a variable speed gear pump through a heated hose. The polyhydroxy compound is preferably extruded onto the surface of the paper web at a temperature that permits the polyhydroxy compound to bond to the paper web. Depending on the particular embodiment, the polyhydroxy compound can be at least partially transferred to rolls in a metering stack (if used) and then to the paper web.

Additionally, the polyhydroxy compound may be applied to a paper web by an apparatus comprising a fluid transfer component. The fluid transfer component preferably comprises a first surface and a second surface. The fluid transfer component further preferably comprises pores connecting the first surface and the second surface. The pores are disposed upon the fluid transfer component in a non-random pre-selected pattern. A fluid supply is operably connected to the fluid transfer component such that a fluid (such as the polyhydroxy compound) may contact the first surface of the fluid transfer component. The apparatus further comprises a fluid motivating component. The fluid motivating component provides an impetus for the fluid to move from the first surface to the second surface via the pores. The apparatus further comprises a fluid receiving component comprising a paper web. The paper web comprises a fluid receiving (or outer) surface. The fluid receiving surface may contact droplets of fluid formed upon the second surface. Fluid may pass through pores from the first surface to the second surface and may transfer to the fluid receiving surface.

The fluid transfer component may comprise a hollow cylindrical shell. The cylindrical shell may be sufficiently structural to function without additional internal bracing. The cylindrical shell may comprise a thin outer shell and structural internal bracing to support the cylindrical shell. The cylindrical shell may comprise a single layer of material or may comprise a laminate. The laminate may comprise layers of a similar material or may comprise layers dissimilar in material and structure. In one embodiment the cylindrical shell comprises a stainless steel shell having a wall thickness of about 0.125 inches (3 mm). In another embodiment the fluid transfer component may comprise a flat plate. In another embodiment the fluid transfer component may comprise a regular or irregular polygonal prism.

The fluid application width of the apparatus may be adjusted by providing a single fluid transfer component of appropriate width. Multiple individual fluid application components may be combined in a series to achieve the desired width. In a non-limiting example, a plurality of stainless steel cylinders each having a shell thickness of about 0.125 inches (3 mm) and a width of about 6 inches (about 15 cm) may be coupled end to end with an appropriate seal—such as an o-ring seal between each pair of cylinders. In this example, the number of shells combined may be increased until the desired application width is achieved.

The fluid transfer component preferably further comprises pores connecting the first surface and the second surface. Connecting the surfaces refers to the pores each providing a pathway for the transport of a fluid from the first surface to the second surface. In one embodiment, the pores may be formed by the use of electron beam drilling as is known in the art. Electron beam drilling comprises a process whereby high energy electrons impinge upon a surface resulting in the formation of holes through the material. In another embodiment, the pores may be formed using a laser. In another embodiment, the pores may be formed by using a drill bit. In yet another embodiment, the pores may be formed using electrical discharge machining as if known in the art.

In one embodiment, an array of pores may be disposed to provide a uniform distribution of fluid droplets to maximize the ratio of fluid surface area to applied fluid volume. In one embodiment, this may be used to apply a chemical softening agent in a pattern of dots to maximize the potential for adhesion between two surfaces for any volume of applied chemical softening agent.

The pattern of pores upon the second surface may comprise an array of pores having a substantially similar diameter or may comprise a pattern of pores having distinctly different pore diameters. In an alternative embodiment, the array of pores may comprise a first set of pores having a first diameter and arranged in a first pattern. The array further comprises a second set of pores having a second diameter and arranged in a second pattern. The first and second patterns may be arranged to interact each with the other.

Alternatively, the polyhydroxy compounds may be sprayed directly onto the surface of a paper web using equipment suitable for such a purpose and as well known to those of skill in the art.

Example 1

A 3% by weight aqueous slurry of NSK (northern softwood Kraft) is made in a conventional re-pulper. The NSK slurry is refined, and a 2% solution of Kymene 557LX is added to the NSK stock pipe at a rate sufficient to deliver 1% Kymene 557LX by weight of the dry fibers. The absorption of the wet strength resin is enhanced by passing the treated slurry though an in-line mixer. KYMENE 557LX is supplied by Hercules Corp of Wilmington, Del. A 1% solution of carboxy methyl cellulose is added after the in-line mixer at a rate of 0.15% by weight of the dry fibers to enhance the dry strength of the fibrous structure. The aqueous slurry of NSK fibers passes through a centrifugal stock pump to aid in distributing the CMC. An aqueous dispersion of DiTallow DiMethyl Ammonium Methyl Sulfate (DTDMAMS) (170° F./76.6° C.) at a concentration of 1% by weight is added to the NSK stock pipe at a rate of about 0.05% by weight DTDMAMS per ton of dry fiber weight.

A 3% by weight aqueous slurry of eucalyptus fibers is made in a conventional re-pulper. A 2% solution of Kymene 557LX is added to the eucalyptus stock pipe at a rate sufficient to deliver 0.25% Kymene 557LX by weight of the dry fibers. The absorption of the wet strength resin is enhanced by passing the treated slurry though an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as separate layers until discharged onto a traveling Fourdrinier wire. A three-chambered headbox is used. The eucalyptus slurry containing 65% of the dry weight of the tissue ply is directed to the chamber leading to the layer in contact with the wire, while the NSK slurry comprising 35% of the dry weight of the ultimate tissue ply is directed to the chamber leading to the center and inside layer. The NSK and eucalyptus slurries are combined at the discharge of the headbox into a composite slurry.

The composite slurry is discharged onto the traveling Fourdrinier wire and is dewatered assisted by a deflector and vacuum boxes. The Fourdrinier wire is of a 5-shed, satin weave configuration having 105 machine-direction and 107 cross-machine-direction monofilaments per inch. The speed of the Fourdrinier wire is about 800 fpm (feet per minute).

The embryonic wet web is dewatered to a consistency of about 15% just prior to transfer to a patterned drying fabric made in accordance with U.S. Pat. No. 4,529,480. The speed of the patterned drying fabric is the same as the speed of the Fourdrinier wire. The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 0.009 inches above the supporting fabric. The drying fabric for forming the paper web has about 562 discrete deflection regions per square inch. The area of the continuous network is about 50 percent of the surface area of the drying fabric.

Further dewatering is accomplished by vacuum assisted drainage until the web has a fiber consistency of about 25%. While remaining in contact with the patterned drying fabric, the web is pre-dried by air blow-through pre-dryers to a fiber consistency of about 65% by weight. The web is then adhered to the surface of a Yankee dryer, and removed from the surface of the dryer by a doctor blade at a consistency of about 97 percent. The Yankee dryer is operated at a surface speed of about 800 feet per minute. The dry web is passed through a rubber-on-steel calendar nip. The dry web is wound onto a roll at a speed of 680 feet per minute to provide dry foreshortening of about 15 percent. The resulting web has between about 562 and about 650 relatively low density domes per square inch (the number of domes in the web is between zero percent to about 15 percent greater than the number of cells in the drying fabric, due to dry foreshortening of the web).

Two plies are combined with the wire side facing out. During the converting process, a surface softening agent is applied with a slot extrusion die to the outside surface of both plies. The surface softening agent is a formula containing one or more polyhydroxy compounds (Polyethylene glycol, Polypropylene glycol, and/or copolymers of the like marketed by BASF Corporation of Florham Park, N.J.), glycerin (marketed by PG Chemical Company), and silicone (i.e. MR-1003, marketed by Wacker Chemical Corporation of Adrian, Mich.). The solution is applied to the web at a rate of 10% by weight. The plies are then bonded together with mechanical ply-bonding wheels, slit, and then folded into finished 2-ply facial tissue product. Each ply and the combined plies are tested in accordance with the test methods described supra.

Example 2

The individual plies of Example 2 are made according to the process detailed in Example 1 supra. Two plies were combined with the wire side facing out. During the converting process, a surface softening agent is applied with a slot extrusion die to the outside surface of both plies. The surface softening agent is applied by component in the following sequence: silicone (i.e. MR-1003, marketed by Wacker Chemical Corporation of Adrian, Mich.) followed by one or more polyhydroxy compounds (Polyethylene glycol, Polypropylene glycol, and/or copolymers of the like marketed by BASF Corporation of Florham Park, N.J.) and/or glycerin. The polyhydroxy compound may also be mixed with glycerin (marketed by PG Chemical Company). The solution, the neat polyhydroxy or a mixture, with other polyhydroxy compounds and/or glycerin or neat glycerin, is applied to the web at a rate of 20% by weight. The plies are then bonded together with mechanical ply-bonding wheels, slit, and then folded into finished 2-ply facial tissue product. Each user unit tested in accordance with the test methods described supra.

Example 3

The individual plies of Example 3 are made according to the process detailed in Example 1 supra. Two plies were combined with the wire side facing out. During the converting process, a surface softening agent and a lotion are applied sequentially with slot extrusion dies to the outside surface of both plies. The surface softening agent is a formula comprising one or more polyhydroxy compounds (Polyethylene glycol, Polypropylene glycol, and/or copolymers thereof marketed by BASF Corporation of Florham Park, N.J.), glycerin (marketed by PG Chemical Company), and silicone (i.e. MR-1003, marketed by Wacker Chemical Corporation of Adrian, Mich.). The surface softening agent is applied to the web at a rate of 14.1% by weight and the lotion is applied to the web at a rate of 5.0% by weight. The plies are then bonded together with mechanical ply-bonding wheels, slit, and then folded into finished 2-ply facial tissue product. Each user unit tested in accordance with the test methods described supra.

Example 4

The individual plies of Example 4 are made according to the process detailed in Example 1 supra. Two plies were combined with the wire side facing out. During the converting process, a surface softening agent and a lotion are applied sequentially with slot extrusion dies to the outside surface of both plies. The surface softening agent is a formula comprising one or more polyhydroxy compounds (Polyethylene glycol, Polypropylene glycol, and/or copolymers thereof marketed by BASF Corporation of Florham Park, N.J.), glycerin (marketed by PG Chemical Company), and silicone (i.e. MR-1003, marketed by Wacker Chemical Corporation of Adrian, Mich.). The surface softening agent is applied to the web at a rate of 10.0% by weight and the lotion is applied to the web at a rate of 5.0% by weight. The plies are then bonded together with mechanical ply-bonding wheels, slit, and then folded into finished 2-ply facial tissue product. Each user unit tested in accordance with the test methods described supra.

Example 5

The individual plies of Example 5 are made according to the process detailed in Example 1 supra. Two plies were combined with the wire side facing out. During the converting process, a surface softening agent and a lotion are applied sequentially with slot extrusion dies to the outside surface of both plies. The surface softening agent is a formula comprising one or more polyhydroxy compounds (Polyethylene glycol, Polypropylene glycol, and/or copolymers thereof marketed by BASF Corporation of Florham Park, N.J.), glycerin (marketed by PG Chemical Company), and silicone (i.e. MR-1003, marketed by Wacker Chemical Corporation of Adrian, Mich.). The surface softening agent is applied to the web at a rate of 10.0% by weight and the lotion is applied to the web at a rate of 10.4% by weight. The plies are then bonded together with mechanical ply-bonding wheels, slit, and then folded into finished 2-ply facial tissue product. Each user unit tested in accordance with the test methods described supra.

Analytical and Testing Procedures

The following test methods are representative of the techniques utilized to determine the physical characteristics of the multi-ply tissue product associated therewith.

1. Sample Conditioning and Preparation

Unless otherwise indicated, samples are conditioned according to Tappi Method #T402OM-88. Paper samples are conditioned for at least 2 hours at a relative humidity of 48 to 52% and within a temperature range of 22° to 24° C. Sample preparation and all aspects of testing using the following methods are confined to a constant temperature and humidity room.

2. Basis Weight

Basis weight is measured by preparing one or more samples of a certain area (m2) and weighing the sample(s) of a fibrous structure according to the present invention and/or a paper product comprising such fibrous structure on a top loading balance with a minimum resolution of 0.01 g. The balance is protected from air drafts and other disturbances using a draft shield.

Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

3. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 $g/in^2$ (14.7 $g/cm^2$).

4. Wet Burst

For the purposes of determining, calculating, and reporting 'wet burst', 'total dry tensile', and 'dynamic coefficient of friction' values infra, a unit of 'user units' is hereby utilized for the products subject to the respective test method. As would be known to those of skill in the art, bath tissue and paper toweling are typically provided in a perforated roll format where the perforations are capable of separating the tissue or towel product into individual units. A 'user unit' (uu) is the typical finished product unit that a consumer would utilize in the normal course of use of that product. In this way, a single-, double, or even triple-ply finished product that a consumer would normally use would have a value of one user unit (uu). For example, a common, perforated bath tissue or paper towel having a single-ply construction would have a value of 1 user unit (uu) between adjacent perforations. Similarly, a single-ply bath tissue disposed between three adjacent perforations would have a value of 2 user units (2 uu). Likewise, any two-ply finished product that a consumer would normally use and is disposed between adjacent perforations would have a value of one user unit (1 uu). Similarly, any three-ply finished consumer product would normally use and is disposed between adjacent perforations would have a value of one user unit (1 uu). For purposes of facial tissues that are not normally provided in a roll format, but as a stacked plurality of discreet tissues, a facial tissue having one ply would have a value of 1 user unit (uu). An individual two-ply facial tissue product would have a value of one user unit (1 uu), etc.

Wet burst strength is measured using a Thwing-Albert Intelect II STD Burst Tester. 8 uu of tissue are stacked in four groups of 2 uu. Using scissors, cut the samples so that they are approximately 208 mm in the machine direction and approximately 114 mm in the cross-machine direction, each 2 uu thick.

Take one sample strip, holding the sample by the narrow cross direction edges, dipping the center of the sample into a pan filled with about 25 ml of distilled water. Leave the sample in the water four (4.0+/−0.5) seconds. Remove and drain for three (3.0+/−0.5) seconds holding the sample so the water runs off in the cross direction. Proceed with the test immediately after the drain step. Place the wet sample on the lower ring of the sample holding device with the outer surface of the product facing up, so that the wet part of the sample completely covers the open surface of the sample holding ring. If wrinkles are present, discard the sample and repeat with a new sample. After the sample is properly in place on the lower ring, turn the switch that lowers the upper ring. The sample to be tested is now securely gripped in the sample holding unit. Start the burst test immediately at this point by pressing the start button. The plunger will begin to rise. At the point when the sample tears or ruptures, report the maximum reading. The plunger will automatically reverse and return to its original starting position. Repeat this procedure on three more samples for a total of four tests, i.e., 4 replicates. Average the four replicates and divide this average by two to report wet burst per uu, to the nearest gram.

5. Total Dry Tensile Strength

The tensile strength is determined on one inch wide strips of sample using a Thwing Albert Vontage-10 Tensile Tester (Thwing-Albert Instrument Co., 10960 Dutton Rd., Philadelphia, Pa., 19154). This method is intended for use on finished paper products, reel samples, and unconverted stocks.

a. Sample Conditioning and Preparation

Prior to tensile testing, the paper samples to be tested should be conditioned according to Tappi Method #T402OM-88. The paper samples should be conditioned for at least 2 hours at a relative humidity of 48% to 52% and within a temperature range of 22° to 24° C. Sample preparation and all aspects of the tensile testing should also take place within the confines of the constant temperature and humidity room.

For finished products, discard any damaged product. Take 8 uu of tissue and stack them in four stacks of 2 uu. Use stacks 1 and 3 for machine direction tensile measurements and stacks 2 and 4 for cross direction tensile measurements. Cut two 1-inch wide strips in the machine direction from stacks 1 and 3. Cut two 1-inch wide strips in the cross direction from stacks 2 and 4. There are now four 1" wide strips for machine direction tensile testing and four 1-inch wide strips for cross direction tensile testing. For these finished product samples, all eight 1" wide strips are 2 uu thick.

For unconverted stock and/or reel samples, cut a 15-inch by 15-inch sample which is twice the number of plies in a user unit thick from a region of interest of the sample using a paper cutter (JDC-1-10 or JDC-1-12 with safety shield from Thwing-Albert Instrument Co., 10960 Dutton Road, Philadelphia, Pa. 19154). Make sure one 15-inch cut runs parallel to the machine direction while the other runs parallel to the cross direction. Make sure the sample is conditioned for at least 2 hours at a relative humidity of 48% to 52% and within a temperature range of 22° C. to 24° C. Sample preparation and all aspects of the tensile testing should also take place within the confines of the constant temperature and humidity room.

From this preconditioned 15-inch by 15-inch sample which is twice the number of plies in a user unit thick, cut four strips 1-inch by 7-inch with the long 7-inch dimension running parallel to the machine direction. Note these samples as machine direction reel or unconverted stock samples. Cut an additional four strips 1-inch by 7-inch with the long 7-inch dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co., 10960 Dutton Road, Philadelphia, Pa., 19154). There are now a total of eight samples: four 1-inch by 7-inch strips which are twice the number of plies in a uu thick with the 7-inch dimension running parallel to the machine direction and four 1-inch by 7-inch strips which are twice the number of plies in a uu thick with the 7-inch dimension running parallel to the cross direction.

b. Operation of Tensile Tester

For the actual measurement of the tensile strength, use a Thwing Albert Vontage-10 Tensile Tester (Thwing-Albert Instrument Co., 10960 Dutton Rd., Philadelphia, Pa., 19154). Insert the flat face clamps into the unit and calibrate the tester according to the instructions given in the operation manual of the Thwing Albert Vontage-10. Set the instrument crosshead speed to 2.00 in/min and the 1st and 2nd gauge lengths to 4.00 inches. The break sensitivity should be set to 20.0 grams and the sample width should be set to 1.00 inches and the sample thickness at 0.025 inches.

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensile strengths of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2-3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

c. Calculations

For the four machine direction 1-inch wide finished product strips, average the four individual recorded tensile readings. Divide this average by the number of user unit tested to get the MD dry tensile per user unit of the sample. Repeat this calculation for the cross direction finished product strips. To calculate total dry tensile of the sample, sum the MD dry tensile and CD dry tensile. All results are in units of grams/inch.

To calculate the Wet Burst/Total Dry Tensile ratio divide the average wet burst by the total dry tensile. The results are in units of inches.

6. Dynamic Coefficient of Friction

The dynamic coefficient of friction is measured using a Thwing-Albert Friction/Peel Tester Model 225-1. The Friction test is set up by pressing the C.O.F button on the Display Unit to select the Friction Test. The Friction Tester operated with a 2000 gram Load Cell, a padded cell of 200 grams at a speed of 6 in/min over 20 seconds. The test is initiated by depressing the Test Switch on the lower chassis of the front panel. The Load Cell will travel to the right, pulling the sled along with the affixed sample. The test results are displayed on an LCD panel. The display indicates the force in grams required for the sled to move along the test surface, i.e. the friction between usable units along with the static and dynamic coefficients of friction (COF). The displayed force returns to zero after the sled is removed from the test surface.

Ten usable units of tissue are stacked in two sets of five. Using scissors, cut one set of 5 usable units so that they are approximately 153 mm in the machine direction and approximately 114 mm in the cross-machine direction. Do not alter the second set of five usable units.

Using the test surface clamp and double sided tape, take one of the five unaltered usable units and affix to the test surface of the machine. Then, affix one usable unit of the five prepared 153 mm×114 mm prepared samples to the sled. Connect the sled to the Load Cell via the sled hook. Ensure that the LCD load (LD) reads 0.0 grams, that the sample is centered, and that the connecting wire is taut. Initiate the test by depressing the Test Switch on the lower chassis of the front panel. The results will display on the LCD panel. Remove the sled along with the usable unit from the test surface. Remove the 153 mm×114 mm usable unit from the sled. Load new usable units to the test surface and 153 mm×114 mm usable unit to the sled. Return the Load Cell to the starting position for the next test. Repeat test procedure 4 times. The five data points collected for COF are recorded and averaged for each sample condition.

7. Bending Flexibility a. Equipment:

Tissue flexibility is measured using the Kawabata KES-FB2 Pure Bending Tester instrument (KES Kato Tech Co., LTD., 26 Karato-cho Nishikujo Minami-ku, Kyoto 601 Japan) to measure flexural rigidity by bending a sample at a constant rate of curvature change in two directions while measuring the bending moment. The sample is held between two clamps 1 cm apart. The typical tissue sample width used is approximately 10-21 cm. Curvature, K, is the reciprocal of the radius of the bending circle. The sample is bent at a constant rate of curvature change of 0.5 $cm^{-1}$/sec, starting at K=0, to K=2.35 (±0.03) back to K=0, then to K=−2.5 (±0.03) then finally back to K=0 (K in units cm−1). As the sample is bent, force is measured on a stationary grip. The data results of the full cycle of bending are bending moment (per unit sample width) versus curvature ($cm^{-1}$). The data from each test is saved as a file for subsequent analysis.

b. Method for Measuring Flexibility of a Non-Lotioned Tissue:

Tissue product samples are cut to approximately 15.2 cm×20.3 cm in the machine and cross machine directions, respectively. Each sample in turn is placed in the jaws of the KES-FB2 such that the sample would first be bent with the first surface undergoing tension and the second surface undergoing compression. In the orientation of the KES-FB2 the first surface is right facing and the second surface is left facing. The distance between the front moving jaw and the rear stationary jaw is 1 cm. The sample is secured in the instrument in the following manner.

First the front moving chuck and the rear stationary chuck are opened to accept the sample. The sample is inserted midway between the top and bottom of the jaws. The rear stationary chuck is then closed by uniformly tightening the upper and lower thumb screws until the sample is snug, but not overly tight. The jaws on the front stationary chuck are then closed in a similar fashion. The sample is adjusted for squareness in the chuck, then the front jaws are tightened to insure the sample is held securely. The distance (d) between the front chuck and the rear chuck is 1 cm.

The output of the instrument is load cell voltage (Vy) and curvature voltage (Vx). The load cell voltage is converted to a bending moment (M) normalized for sample width in the following manner:

$$\text{Moment}(M, gf^*cm^2/cm) = (Vy^*Sy^*d)/W$$

Where: Vy is the load cell voltage,
Sy is the instrument sensitivity in gf*cm/V,
d is the distance between the chucks, and
W is the sample width in centimeters.

The sensitivity switch of the instrument is set at 5×1. Using this setting the instrument is calibrated using two 50 g weights. Each weight is suspended from a thread. The thread is wrapped around the bar on the bottom end of the rear stationary chuck and hooked to a pin extending from the front and back of the center of the shaft. One weight thread is wrapped around the front and hooked to the back pin. The other weight thread is wrapped around the back of the shaft and hooked to the front pin. Two pulleys are secured to the instrument on the right and left side. The top of the pulleys are horizontal to the center pin. Both weights are then hung over the pulleys (one on the left and one on the right) at the same time. The full scale voltage is set at 10 V. The radius of the center shaft is 0.5 cm. Thus the resultant full scale sensitivity (Sy) for the Moment axis is 100 gf*0.5 cm/10V (5 gf*cm/V).

The output for the Curvature axis is calibrated by starting the measurement motor and manually stopping the moving chuck when the indicator dial reached 1.0 cm−1. The output voltage (Vx) is adjusted to 0.5 volts. The resultant sensitivity (Sx) for the curvature axis is 2/(volts*cm). The curvature (K) is obtained in the following manner:

$$\text{Curvature}(K, cm^{-1}) = Sx^*Vx$$

Where: Sx is the sensitivity of the curvature axis, and
Vx is the output voltage For determination of the bending stiffness the moving chuck is cycled from a curvature of 0 $cm^{-1}$ to +1 $cm^{-1}$ to −1 $cm^{-1}$ to 0 $cm^{-1}$ at a rate of 0.5 cm−1/sec. Each sample is cycled continuously until four complete cycles are obtained. The output voltage of the instrument is recorded in a digital format using a personal computer. A typical output for a bending stiffness test is shown in FIG. 4. At the start of the test there is no tension on the sample. As the test begins the load cell begins to experience a load as the sample is bent. The initial rotation is clockwise when viewed from the top down on the instrument.

In the forward bend the first surface of the fabric is described as being in tension and the second surface is being compressed. The load continued to increase until the bending curvature reached approximately +1 $cm^{-1}$ (this is the Forward Bend (FB). At approximately +1 $cm^{-1}$ the direction of rotation is reversed. During the return the load cell reading decreases. This is the Forward Bend Return (FR). As the rotating chuck passes 0 curvature begins in the opposite direction—that is, the sheet side now compresses and the no-sheet side extends. The Backward Bend (BB) extended to approximately −1 $cm^{-1}$ at which the direction of rotation is reversed and the Backward Bend Return (BR) is obtained.

The data are analyzed in the following manner. A linear regression line is obtained between approximately 0.2 and 0.7 $cm^{-1}$ for the Forward Bend (FB) and the Forward Bend Return (FR). A linear regression line is obtained between approximately −0.2 and −0.7 $cm^{-1}$ for the Backward Bend (BB) and the Backward Bend Return (BR). The slope of the line is the Bending Stiffness (B). It has units of gf*$cm^2$/cm.

This is obtained for each of the four cycles for each of the four segments. The slope of each line is reported as the Bending Stiffness (B). It has units of gf*$cm^2$/cm. The Bending Stiffness of the Forward Bend is noted as BFB. The individual segment values for the four cycles are averaged and reported as an average BFB, BFR, BBF, BBR. Two separate samples in the MD and the CD are run. Values for the two samples are averaged together using the square root of the sum of the squares.

c. Method for Measuring Flexibility of a Lotioned Tissue:

1. Set-up and Calibration

Hardware: Turn measurement SENS (sensitivity) knob on equipment to 20. Turn the CHECK instrument knob to OSC—the needle gauge (voltmeter) on the instrument should equal 10+/−0.1 unit. Turn CHECK knob to BAL—the needle gauge on instrument should equal 0+/−0.1 unit. Adjust the AC BAL screw to move the needle into the acceptable range. Turn CHECK knob to ZERO—the gauge should equal 0+/−0.1 unit on the needle gauge. If not, use small screwdriver to turn the ZERO ADJ adjustment screw (front of instrument) to zero. Using a 20 gram weight connected to a fine silk thread with a loop on the end (such as is sold by Kato Tech Co. LTD) remove the back panel of the instrument and hang the 20 g weight from the pin extending from the stationary grip (also referred to as fixed chuck). The needle gauge should equal 10 units (±0.25 units). Connect a digital volt meter to the output terminals "T" and "E" on the instrument face. Record the voltage reading, then remove the 20 g weight from the stationary grip, and record the new voltage reading. The difference between the two voltage readings should with the acceptable range of 9.75 and 10.25 volts. If not, adjust the GAIN adjustment screw (with a flathead screwdriver) until the difference is within the acceptable range. Repeat this procedure until the difference in voltage (with and without 20 g weight attached) is within the acceptable range, then verify the OSC, BAL, and ZERO are in the acceptable range, as described earlier. When finished, turn the CHECK knob to MES—this is the measurement mode for the instrument.

Software: Change the SENS to read 2×1 (this correctly matches the software to the hardware sensitivity settings). Adjust the "Size" to read 20 cm, and the "Mode" to read one cycle. Settings for B and 2HB do not matter, since the raw data file from each test is analyzed separately from the software provided from Kato Tech Co.

2. Sample Preparation

Cut 5 tissue sample uu to approximately 20 cm (±1 cm) long in the machine direction (MD) by 15 cm (±1 cm) in the cross machine direction (CD). Folds that are present in the cut sample, created by the converting process used in making the uu, may be included in the measured test sample; however, any ply-seal marks near the sample edges (which may or may not include glue) are removed the test sample and any effect upon the flexural rigidity measurement is excluded.

3. Measurement

Ensure that the CHECK knob is on MES. To test the MD of the first sample, lay one pre-cut uu sample on the flat chrome instrument sample plate, with the MD pointing towards to and from the person facing instrument front panel (the CD of the sample should be directed left and right relative to the user). Measure the sample width (CD direction) to the nearest 0.1 cm, at a distance approximately 1½ to 2½ inches from the sample end that will be fed into the instrument jaws (i.e., the end furthest from the person standing in front of the instrument). Record the distance (with respect to the sample ID) for later use in data analysis and calculations. Place the sample into the both jaws of the instrument, centered relative to the jaw width. When the sample is adequately positioned through both jaws, a small red light on the instrument illuminates to inform the tester that the test can begin (also, the MEASURE button will not function unless this occurs). Press the MEASURE button—this will cause the instrument to automatically close the jaws, clamping the sample into place. Once the MEASURE button begins to blink on and off, then, using the KES software program, provide a test name and start the measurement. The instrument bends the sample (at a rate of 0.5 $cm^{-1}$/sec) up to a curvature of K=2.35 (±0.03) $cm^{-1}$, then down to a curvature of K=−2.35 (±0.03) $cm^{-1}$, then back to the flat starting point of K=0 $cm^{-1}$. When finished, the results are graphically shown by the KES software. Save raw data from the test to a comma delimited text file, including the sample ID and MD in the name. This file can then be used for any analysis and calculations. Upon completion of the test, the instrument automatically loosens the jaws so the sample moves freely again. Pull the sample away from the jaws.

Next, test the CD of the same sample, by rotating the sample 90 degrees. Again, measure the width (this time in the MD direction) to the nearest 0.1 cm, at a distance approximately 1½ to 2½ inches from the sample end that will be fed into the instrument jaws (i.e., the end furthest from the person standing in front of the instrument). Record the distance (with respect to the sample ID). Slide the sample into the both jaws of the instrument, centered with relative to the jaw's width. When the sample is adequately positioned through both jaws, a small red light on the instrument illuminates to inform the tester that the test can begin. Press the MEASURE button—this will cause the instrument to automatically close the jaws, clamping the sample into place. Once the MEASURE button begins to blink on and off, then, using the KES software program, click the 'Back' button to begin a new test, provide a test name, and start the measurement. The instrument bends the sample as previously described. When finished, the results are graphically shown by the KES software. Save raw data from the test to a comma delimited text file, including the sample ID and CD in the name. This file is used later in analysis and calculations. Upon completion of the test, the instrument automatically loosens the jaws so the sample moves freely again. Pull the sample away from the jaws and discard. Repeat this procedure for the other 4 pre-cut uu test samples.

Next, a test is run with no sample in the instrument. This data will be used to remove the any noise inherent to the measurement system from the test sample measurement data. With nothing in the instrument jaws, a small piece of bond paper temporarily covers the red LED used to detect whether a sample is loaded within the jaws. This enables the instrument MEASURE button, when pressed, to begin closing the jaws and prepare for testing, just as if a sample were present in the instrument jaws. Once the jaws begin to close, the temporary cover on the LED light is removed. Once the MEASURE button begins to blink on and off, then, using the KES software program, click the 'Back' button to begin a new test, provide a test name, and start the measurement. The instrument moves the jaw as previously described. When finished, the results are graphically shown by the KES software. Save raw data from the test to a comma delimited text file, including the sample ID and "blank" in the name. This file is used later in analysis and calculations.

4. Calculations and Analysis

For each test condition, there are 11 data files: five for sample MD, 5 for the sample CD, and 1 for a 'blank' run. Each of these file includes the curvature position (K, in units of $cm^{-1}$) and bending moment per unit length (M, in units of g*cm/cm). Data is acquired (during testing) at a rate of about 10 points per second; thus, each file has roughly 189 data points recorded (±5).

Flexural rigidity is calculated by identifying the maximum and minimum curvature in the data array—the maximum and minimum curvature is between positive and negative 2.32 and 2.38 $cm^{-1}$, respectively. The average of the previous 4 data points just before maximum curvature ($K_{max4}$) and moment ($M_{max4}$), and the previous 4 data points just before minimum curvature ($K_{min4}$) and moment ($M_{min4}$) are then calculated. The uncorrected and un-normalized (for width) flexural rigidity (FRuu) is calculated as follows (units of g*$cm^2$/cm):

$$FRuu=(M_{max4}-M_{min4})/(K_{max4}-K_{min4})$$

Recall from the instrument software set-up required the sample width to be a constant at 20 cm ($W_{20}$) even though the sample width is a variable that was manually measured with a ruler ($W_{act}$). The calculation for uncorrected flexural rigidity (FRu) is as follows:

$$FRu=FRuu*W_{20}/W_{act}$$

The corrected and width normalized flexural rigidity (FR) is then calculated by subtracting the blank flexural rigidity normalized to 20 cm width (FRb), with FRb calculated in the same manner as described previously for FRuu.

$$FR=(FRuu-FRb)*W_{20}/W_{act}$$

This calculation process is performed for each of the 5 MD and 5 CD tests for a given sample condition. The results are then numerically averaged to produce a flexural rigidity for the MD ($FR_{MD}$) and CD ($FR_{CD}$), respectively. The average flexural rigidity ($FR_{AVG}$) for the sample condition is the numerical average of $FR_{MD}$ and $FR_{CD}$.

8. Lotion Transfer Test

A surface covered with a plastic film is rubbed reproducibly against a sample of lotioned tissue. The plastic film is extracted, and the extract is analyzed. The concentration of stearyl alcohol or alternative component from the lotion is determined by gas chromatography using a mass spectrometer detector. Based on the stearyl alcohol concentration, the amount of lotion transferred from the tissue to the film is calculated and reported. (Stearyl alcohol is used a "marker," but another compound in the lotion can be used as well, or instead of, the stearyl alcohol.)

a. Process

The rub tester comprises a stepper motor and drive unit and pallet sled mounted on linear guide track, appropriate gears, and controller. The length of the rub stroke is set to be 1.8 in. (4.57 cm).

The film used is CoTran 9702™ from the 3M Company. A piece is cut 1⅛ in.×4 in (28.575 cm×101.6 mm). This is laid over the film holder and the top piece is used to keep the film in place, leaving an exposed area of 1.395 $in^2$ (9.0 $cm^2$). The film holders are then put in an oven to equilibrate to 92° F. (33° C.) for ½ hour.

The tissues are stored in ~22° C. ambient room temperature with no special tissue conditioning required.

One tissue is folded in half and placed on the tissue holder so the product's consumer side faces the surface to be rubbed. For multi-ply products, the plies are not separated. The issue is placed on the tissue holder, so that it will be rubbed in the machine direction of the tissue. The holder measures 4 in.×4 in (10.16 cm×10.16 cm) with a tissue area of 3½ in.×3½ in. (8.89×8.89 cm). The holder side-pieces are folded over the edges of the tissue to hold it in place and these in turn are held in place by the metal sleeves. Five replicate tissues are prepared and rubbed for each sample.

The tissue holders are mounted on the base of the rubbing apparatus prior to performing a "rub." When the film/film holder ("hand") has equilibrated, it is mounted on the upper piece of the rub tester, which is also heated (and controlled) to 92° F. The 6 "fingers" each have an area of 1.5 $cm^2$ and the total mass is ~750 g, so the net pressure is ~85 g/$cm^2$ or 1.21 lb/$in^2$. Depressing the "start" button begins the "rub." The rub motion takes ~1.7 s. The tissue is rubbed 4.57 cm back and forth against the "hand" for a total of ~9 cm. The film is removed from the holder, touching only the edges, and folded with the lotion to the inside and put in a scintillation vial. The samples are then extracted in this same vial.

b. Calibration Standards and Extractions

A lotion standard stock solution is prepared by adding about 0.10 g lotion to 100 mL of methylene chloride. If the neat lotion used on the tissues is not available, it is extracted from sample tissues, for example, using dichloromethane. This may be done using a Soxhlet or Accelerated Solvent Extraction system. If the ASE is used, 2-3 tissue samples are extracted at a time using 2 ten-minute extractions at 125° C. and 1200 psig. The extracts are combined and used to prepare the standards, after the DCM has evaporated.

Individual lotion standards are prepared by adding different amounts of the lotion stock solution, using gas tight syringes into vials containing fresh pieces of the CoTran™ Membrane of the same size as used in the rub process. Preferred volume ranges of the stock solution are typically between 10-200 μL. The samples, sample blanks, and standards are extracted using 3 mL of methylene chloride. The capped vials are shaken vigorously for 10 minutes on a lab shaker by, using an IKA Labortechnik HS 501 set at 300/min. Transfer the extract to a 2-mL auto-sampler vial with a Teflon-lined silicone cap.

c. Measurement and Calculation

The extracts are analyzed for stearyl alcohol (or other chosen marker) using gas chromatography (GC) with a flame ionization detector. For low levels of marker it may be necessary to use GC with a mass spectrometer in selected ion mode as a detector. GC model, column, temperature settings, etc. appropriate to the lotion are used. For example, an H-P (Agilent) GCD Model G1800B with a DB Wax capillary column, programmed from 35° C. to 240° C. with splitless injection is typically used.

A major peak (component) of the lotion is used to determine total lotion concentration. Alternately, multiple peak areas may be summed and used to determine the lotion concentration. Lotion transfer amounts are then calculated using the calibration curve prepared from the GC results on the standards and reported in μg/$cm^2$ of "skin.

Results

The products produced above in Examples 1 and 2, as well as several exemplary and commercially available products were tested using the test methods described supra. The results of this testing data are presented below in Table 1.

TABLE 1

Exemplary test results and data values for samples analyzed as discussed herein.

| Product Type | Sample ID | Total Dry Tensile (g/in) | Wet Burst (g) | WB/TDT ratio (in) | COF - Dynamic | Basis Weight (g/$m^2$) | Bulk Density @ 95 g/$in^2$ (g/$cm^3$) | Bending Flexibility (gf * $cm^2$/cm) (mg * $cm^2$/cm)* | Rub Value (μg/$cm^2$) |
|---|---|---|---|---|---|---|---|---|---|
| Facial Tissue | Puffs Basic | 435 | 85 | 0.20 | 0.887 | 29 | 0.05 | 0.038 | |
| | Tempo | 1715 | 232 | 0.14 | | 64 | 0.07 | 0.186 | |
| | Puffs Ultra 07 | 727 | 137 | 0.19 | 0.922 | 37 | 0.07 | 0.048 | |
| | Kleenex Regular | 470 | 42 | 0.09 | 1.017 | 29 | 0.07 | | |
| | Kleenex Ultra | 577 | 66 | 0.11 | 0.880 | 43 | 0.05 | | |
| | Puff's Plus | 635 | 116 | 0.18 | 0.80 | 28 | 0.14 | 42.3 | 8.4 |
| | Kleenex Lotion 2007 | 729 | 70 | 0.10 | | 26.5 | 0.19 | | 2.1 |
| | Kleenex Lotion 2008 | 806 | 77 | 0.10 | | 29.5 | 0.13 | 10.1* | 1.5 |
| | Example 1 | 660 | 136 | 0.21 | 0.842 | 40 | 0.08 | 0.042 | |
| | Example 2 | 605 | 141 | 0.23 | 0.808 | 40 | 0.08 | 0.033 | |
| | Lotion Example 3 | 485 | 83 | 0.17 | 0.76 | 43.3 | 0.17 | 11.4* | 1.2 |
| | Lotion | 575 | 85 | 0.15 | 0.77 | 43.6 | 0.15 | 15.3* | 1.9 |

TABLE 1-continued

Exemplary test results and data values for samples analyzed as discussed herein.

| Product Type | Sample ID | Total Dry Tensile (g/in) | Wet Burst (g) | WB/TDT ratio (in) | COF - Dynamic | Basis Weight ($g/m^2$) | Bulk Density @ 95 $g/in^2$ ($g/cm^3$) | Bending Flexibility ($gf * cm^2/cm$) ($mg * cm^2/cm$)* | Rub Value ($\mu g/cm^2$) |
|---|---|---|---|---|---|---|---|---|---|
| | Example 4 Lotion | 572 | 91 | 0.16 | 0.83 | 45.1 | 0.14 | 20.6* | 3.9 |
| | Example 5 | | | | | | | | |
| Paper Towel | Bounty Extra Soft | 1269 | 326 | 0.26 | | 60 | 0.04 | 0.223 | |
| | Bounty | 1508 | 340 | 0.23 | | 42 | 0.03 | 0.127 | |
| | 1st Quality | 2304 | 311 | 0.14 | | 40 | 0.03 | 0.230 | |
| | Brawny | 1922 | 262 | 0.14 | | 48 | 0.04 | 0.312 | |
| | Sparkle | 1930 | 213 | 0.11 | | 47 | 0.04 | 0.213 | |
| | Viva Wet Laid | 727 | 336 | 0.46 | | 66 | 0.05 | 0.117 | |
| | Scott 1 ply | 1623 | 282 | 0.17 | | 36 | 0.05 | 0.277 | |
| Bath Tissue | Charmin Basic | 495 | 22 | 0.04 | | 30 | 0.11 | | |
| | Charmin Ultra Soft | 486 | 47 | 0.10 | | 48 | 0.05 | | |
| | Charmin Ultra Strong | 799 | 33 | 0.04 | | 38 | 0.04 | | |
| | Charmin Lotion | 384 | | | 0.74 | 49 | .38 | 17.9 | |
| | Scott Extra Soft | 634 | 4 | 0.01 | | 18 | 0.12 | | |
| | Quilted Northern | 480 | 20 | 0.04 | | 37 | 0.06 | | |
| | Quilted Northern Ultra | 444 | 20 | 0.04 | | 47 | 0.06 | | |
| | Cottonelle | 429 | 29 | 0.07 | | 30 | 0.04 | | |
| | Cottonelle Aloe and E | 418 | 28 | 0.07 | | 29 | 0.03 | | |
| | Cottonelle Ultra | 630 | 34 | 0.05 | | 45 | 0.04 | | |

A preferred embodiment of the present invention provides a wet burst value of greater than about 80 grams, preferably ranges from about 90 grams to 400 grams, more preferably ranges from about 100 grams to about 200 grams. A preferred embodiment of the product of the present invention provides a dynamic coefficient of friction value of less than about 0.9, preferably ranging from about 0.6 to about 0.9, more preferably ranges from about 0.6 to about 0.85, and even more preferably ranges from about 0.75 to about 0.85. A preferred embodiment of a product of the present invention having no lotion applied thereto provides a bending flexibility of less than about 0.1 $gf*cm^2/cm$, preferably ranges from about 0.02 $gf*cm^2/cm$ to about 0.06 $gf*cm^2/cm$, and more preferably ranges from about 0.03 $gf*cm^2/cm$ to about 0.05 $gf*cm^2/cm$. A preferred embodiment of a product of the present invention having lotion applied thereto provides a bending flexibility of less than about 50 $mg*cm^2/cm$, preferably ranges from about 5 $mg*cm^2/cm$ to about 30 $mg*cm^2/cm$, and more preferably ranges from about 10 $mg*cm^2/cm$ to about 21 $mg*cm^2/cm$. A preferred embodiment of the present invention provides a wet burst/total dry tensile ratio value of greater than about 0.12 inches, preferably ranges from about 0.14 inches to about 0.30 inches, and more preferably ranges from about 0.16 inches to about 0.24 inches. A preferred embodiment of a product of the present invention having lotion applied thereto provides a mechanical rub test value of greater than about 0.5 $\mu g/cm^2$, and preferably greater than about 1.0 $\mu g/cm^2$.

The dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A paper product having at least one ply, wherein only one outer surface of said paper product has a polyhydroxy compound comprising polyethylene glycol (PEG) having a molecular weight ranging from about 200 to about 2,000 applied thereto by slot extrusion and a lotion applied thereto, said paper product having a Wet Burst greater than about 80 grams, a Dynamic Coefficient of Friction of less than about 0.9, and a Bending Flexibility of less than about 50 mg*cm$^2$/cm.

2. The paper product of claim 1 wherein said lotion comprises:

a. From about 10 percent to about 90 percent of a compound selected from the group consisting of oils, emollients, and waxes; and, b. Less than about 20 percent of water content.

3. The paper product of claim 2 wherein the lotion composition further comprises from at least about 15 percent to about 100 percent solids content.

4. The paper product of claim 1 further comprising a chemical softening agent.

5. The paper product of claim 1 wherein said paper product comprises from about 2.0 percent to about 25.0 percent of said lotion based upon a dry fiber weight of said paper product.

6. The paper product of claim 5 wherein said paper product comprises from about 4.0 percent to about 11.0 percent of said lotion based on the dry fiber weight of the paper product.

7. The paper product of claim 1 wherein said lotion comprises a compound selected from the group consisting of glycols, polyglycols, petrolatum, fatty acids, fatty alcohols, fatty alcohol ethoxylates, fatty alcohol esters and fatty alcohol ethers, fatty acid ethoxylates, fatty acid amides and fatty acid esters, hydrocarbon oils, squalane, fluorinated emollients, silicone oil, and mixtures thereof.

8. The paper product of claim 1 wherein said lotion comprises an emollient selected from the group consisting of petroleum-based emollients, fatty acid ester type emollients, alkyl ethoxylate type emollients, and combinations thereof.

9. The paper product of claim 1, wherein said polyhydroxy compound comprises from about 2.0 percent to about 30.0 percent of a water soluble polyhydroxy compound based upon a dry fiber weight of said paper product.

10. The paper product of claim 9, wherein said polyhydroxy compound comprises from about 5.0 percent to about 20.0 percent of said water soluble polyhydroxy compound based upon said dry fiber weight of said paper product.

11. The paper product of claim 10, wherein said polyhydroxy compound comprises from about 8.0 percent to about 15.0 percent of said water soluble polyhydroxy compound based upon said dry fiber weight of said paper product.

12. The paper product of claim 1, wherein said paper product has a basis weight ranging from between about 5 g/m$^2$ and about 120 g/m$^2$.

13. The paper product of claim 1, wherein said paper product has a density ranging from between about 0.01 g/cm$^3$ and about 0.19 g/cm$^3$.

14. The paper product of claim 1, wherein said paper product is creped.

15. A paper product having at least one ply, wherein only one outer surface of said paper product comprises from about 0.1 g/m$^2$ to about 36 g/m$^2$ of a polyhydroxy compound comprising polyethylene glycol (PEG) having a molecular weight ranging from about 200 to about 2,000 applied thereto by slot extrusion and from about 0.1 g/m$^2$ to about 30 g/m$^2$ of a lotion applied thereto, said paper product having a Bending Flexibility of less than about 50 mg*cm$^2$/cm and a Mechanical Rub Test Value of greater than about 0.5 μg/cm$^2$.

16. The paper product of claim 15 wherein said paper product comprises from about 0.65 g/m$^2$ to about 12 g/m$^2$ of said polyhydroxy compound and from about 0.65 g/m$^2$ to about 10 g/m$^2$ of said lotion applied thereto.

17. A paper product having at least one ply, wherein only one outer surface of said paper product comprises from about 2.0 percent to about 25.0 percent of a lotion based upon a dry fiber weight of said paper product and from about 2.0 percent to about 30.0 percent of a water soluble polyhydroxy compound based upon a dry fiber weight of said paper product, said polyhydroxy compound comprising polyethylene glycol (PEG) having a molecular weight ranging from about 200 to about 2,000 applied by slot extrusion to said one outer surface, said paper product having a Wet Burst/Total Dry Tensile ratio of greater than about 0.12 inches and a Bending Flexibility of less than about 50 mg*cm$^2$/CM.

18. The paper product of claim 17 further comprises from about 4.0 percent to about 11.0 percent of said lotion based on the dry fiber weight of said paper product from about 5.0 percent to about 20.0 percent of said water soluble polyhydroxy compound based upon said dry fiber weight of said paper product.

* * * * *